US007073668B2

(12) United States Patent
Alford et al.

(10) Patent No.: US 7,073,668 B2
(45) Date of Patent: Jul. 11, 2006

(54) MAGNETIC SEPARATORS

(75) Inventors: Nicholas Mark Alford, Bath (GB); William Frederick Smith-Haddon, Monmouthshire (GB)

(73) Assignee: Cross Manufacturing Company (1938) Limited, Bath (GB)

( * ) Notice: Subject to any disclaimer, the term of this patent is extended or adjusted under 35 U.S.C. 154(b) by 73 days.

(21) Appl. No.: 10/601,974

(22) Filed: Jun. 23, 2003

(65) Prior Publication Data

US 2004/0035760 A1 Feb. 26, 2004

Related U.S. Application Data

(60) Provisional application No. 60/407,922, filed on Sep. 3, 2002.

(30) Foreign Application Priority Data

Jun. 25, 2002 (GB) ..... 0214593

(51) Int. Cl.
*B03C 1/10* (2006.01)

(52) U.S. Cl. ..... 209/216; 209/217; 209/223.2; 209/232; 210/222

(58) Field of Classification Search ..... 209/39, 209/213, 216, 217, 223.2, 228, 232; 210/222, 210/223

See application file for complete search history.

(56) References Cited

U.S. PATENT DOCUMENTS

| | | | | |
|---|---|---|---|---|
| 2,789,655 | A * | 4/1957 | Preston et al. | 210/223 |
| 2,951,586 | A * | 9/1960 | Moriya | 210/223 |
| 3,712,472 | A * | 1/1973 | Elliott | 210/222 |
| 4,444,659 | A | 4/1984 | Beelitz et al. | |
| 4,457,838 | A | 7/1984 | Carr | |
| 4,722,788 | A * | 2/1988 | Nakamura | 210/222 |
| 5,076,914 | A * | 12/1991 | Garaschenko et al. | 210/186 |
| 6,099,739 | A | 8/2000 | Kobayashi | |
| 2002/0139740 | A1 * | 10/2002 | Asterlin | 210/222 |

FOREIGN PATENT DOCUMENTS

| | | | |
|---|---|---|---|
| GB | 850233 | A | 10/1960 |
| JP | 63278569 | A | 5/1987 |
| JP | 6218298 | A | 8/1994 |
| JP | 6269695 | A | 9/1994 |
| JP | 200317342 | A | 11/2000 |

* cited by examiner

*Primary Examiner*—Joseph Rodriguez
(74) *Attorney, Agent, or Firm*—King & Schickli, PLLC

(57) ABSTRACT

A magnetic separator includes a chamber 11 having inlets and outlets 12, 13 which together define a flow path 14. Axially extending tubes 15 are disposed in an array around the cross-section of the chamber 11 and the perforated baffle plate 18 divides the chamber 11 into top and bottom components 16, 17. Each tube contains a magnetic shuffle 19, which can be moved up and down the tube between separator and release positions using a pneumatic control system.

27 Claims, 3 Drawing Sheets

MAGNETIC SEPARATORS

This application claims the benefit of U.S. Provisional Patent Application Ser. No. 60/407,922, filed Sep. 3, 2002.

FIELD OF THE INVENTION

This invention relates to magnetic separators.

BACKGROUND OF THE INVENTION

Magnetic separators are used extensively in many industries to remove magnetic or magnetisable materials, e.g. ferrous contamination, from process materials.

For those process materials which are fluent, it is known to locate tubes across the material flow path and have, magnets located in the tubes so that the contaminant material is attracted to the surfaces of the tubes and retained there. Periodically the flow of material is switched off and the magnets are withdrawn from the tubes allowing the contamination to be released from the walls of the tubes. Traditionally this withdrawal took place manually, but proposals have been made for powered systems using pneumatic rams to withdraw and insert the magnets either under manual control or under the control of some control system. When withdrawn, the magnets do not perform any separator or filtering function and therefore the flow of material must cease prior to withdrawal. Further a hopper or the like is usually disposed across the bottom of the separator so that the released material can fall into the hopper and be removed from the system. Particularly where gases or liquids are involved, significant sealing difficulties can arise.

SUMMARY OF THE INVENTION

From one aspect the invention consists in a magnetic separator for separating magnetic or magnetisable material from a fluid flow path including one tube portion disposable in the flow path and a magnet in the tube portion movable between a separator position in the tube portion and a release position in which the magnet is withdrawn from the tube portion characterised in that the magnet is in the form of a shuttle and in that the tube portion is part of a longer tube disposable within the flow path whereby the magnet can be moved between its positions by differential pressure being created across the magnet.

Preferably the tube is generally aligned with the direction of flow, so that the release position is upstream of the separator position.

It is particularly preferred there are a plurality of tubes, which can be arranged within an array (e.g. circular) within the flow path, in which case there is a magnetic shuttle in each tube. The number of tube portions required depends on the size of the flow cross section, the rate of flow and the strength of the magnet.

Conveniently the magnetic shuttle includes a linear array of magnets and seals at either end of the array for sealing within the inner face of the tube. The shuttle or shuttles can then be moved along the tube by means of differential fluid pressure extending across the shuffle. Most conveniently each tube has a valve at either end for allowing the introduction of compressed air so that the shuffle can be moved in the desired direction, although the fluid itself could be used as a power source, as could vacuum sources.

The tubes may be dispersed in a generally annular chamber and the chamber may be divided by a generally annular baffle plate which may be formed to allow flow throughout or past it.

The baffle plate may encircle the tube or tubes at a location between the positions. The provision of such a plate enhances the retention of separated material adjacent the separator location, when the shuttle, or shuttles, is moved to its release position. The separator may include an outlet valve for directing the fluid in the first direction when the shuttle is in its separator position and in a second direction when the shuttle is not in its separator position. In this way the fluid can be used to flush out the separated material into a reservoir from where the separator material can be collected by settling, further magnetic separation or other techniques. Alternatively non-system fluid can be used for flushing.

This is preferred if the system pressure is low and/or the nature of the system fluid is such that it is preferably retained in the system e.g. it is too hot, radioactive, corrosive etc.

It will be understood that as the release position is contained within the flow path, the shuttle, or shuttles, continue to separate out contaminant material. This means that the outlet valve can safely be switched to the first or normal position before or as the shuttles are moved into the separator position and therefore there is very little dead time involved. Further, because the fluid flow is used to flush out the separator material, there is very little chance of downstream contamination occurring.

Conveniently the tube or tubes are disposed in a chamber which is divided by the baffle plate with, as has already been indicated, the release position upstream of the baffle and the separator position downstream of the baffle.

From a further aspect the invention consists in a magnetic separator comprising a plurality of tubes disposable in a flow path and containing magnets movable within the tube between a separator position and a release position characterised in that the tubes are arranged in a circular array.

From another aspect the invention consists in a magnetic separator for separating magnetisable or magnetic material from fluid flow flowing along a flow path including a magnet-movable between a separator position and a release position characterised in that the release position also lies within the flow path.

Although the invention has been defined above it is to be understood it includes any inventive combination of the features set out above or in the following description.

BRIEF DESCRIPTION OF THE DRAWINGS

The invention can be performed in various ways and specific embodiments will now be described by way of example, in which.

Figure 1:
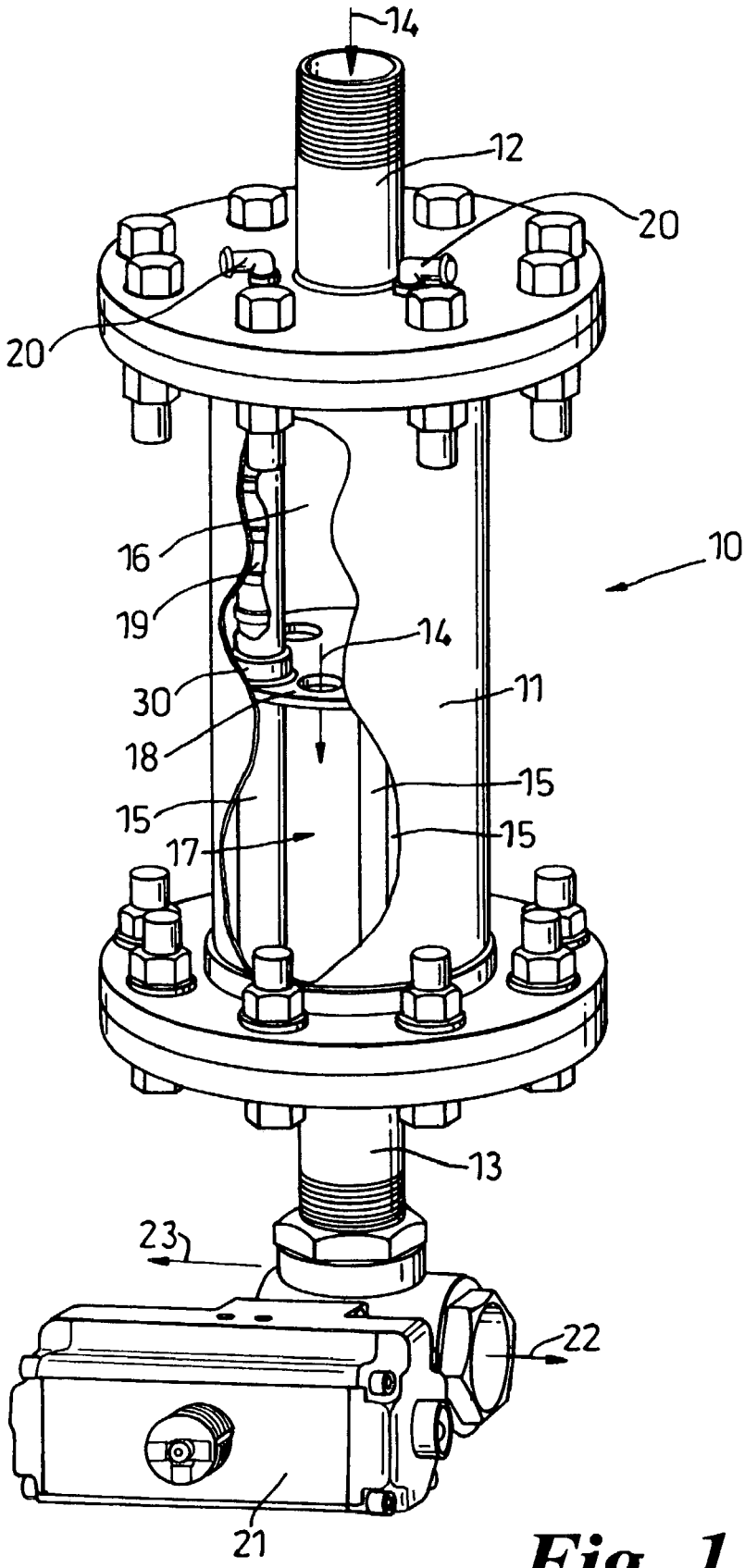
FIG. 1 is a partially cut-away perspective view of a magnetic separator.

A magnetic separator generally indicated at 10 includes a chamber 11 having inlets and outlets 12, 13 which together define a flow path 14. The cylindrical chamber 11 has axially extending tubes 15 disposed in an array around its cross-section and is divided into top and bottom compartments 16, 17 by a perforate baffle plate 18, through which the tubes 15 extend. Each tube contains a magnetic shuttle 19, which will be described in more detail below. The shuttles 19 are a friction fit within their respective tube 15 so that they can take any vertical position into which they are moved.

Pneumatic inlets 20 are located at each end of each tube 15 so that compressed air can be blown into the tube, from one end or the other to move the shuttles 19 from the release position shown in FIG. 1, in compartment 16, to a separator position, where the shuttle lies within compartment 17.

A two-way outlet valve 21 is attached to the outlet 13. In normal use the outlet valve 21 directs flow in the process direction 22, but in its second position it directs flow in direction 23, where it passes into a settling tank, sump or other reservoir.

Figure 2:
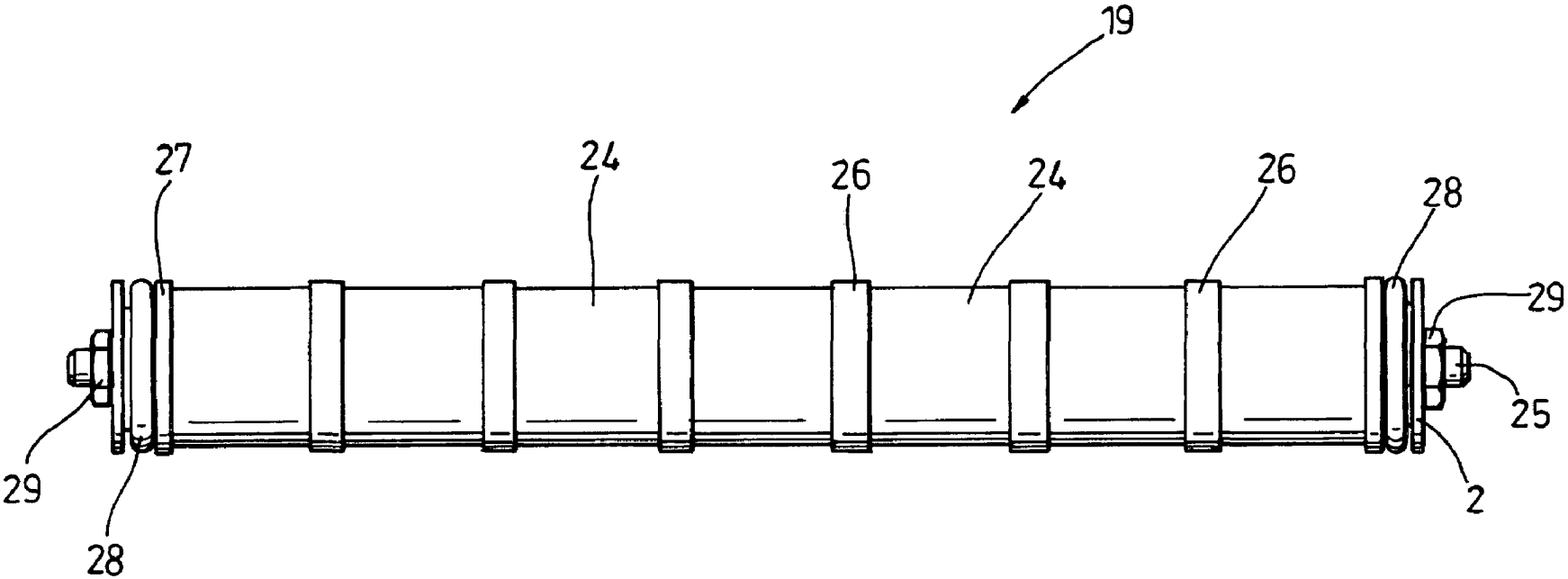
FIG. 2 is a side view of a magnetic shuttle for use with the apparatus of FIG. 1.

Turning to FIG. 2, each shuttle 19 comprises annular magnets 24, which are threaded, with a clearance fit, onto a rod 25 with intervening pole pieces 26. The magnets are arranged so that unlike poles are adjacent to each other. At the end of the linear array of magnets and pole pieces 24, 26 are non-magnetic retaining discs 27 that are grooved to receive a sealing O-ring 28.

Lock nuts 29 retain the array on the rod 25. As has been indicated the shuttles 19 are a sufficient friction fit within their respective tubes 15 to take whatever position they are moved into.

In normal use, the shuttles 19 are disposed in their separator position at the downstream end of the tubes 15 within the compartment 17. Fluid flows down the flow path 14 and out through the outlet valve 21 in the direction 22. As the fluid passes along the tubes 15 within the lower compartment 17, any magnetic or magnetisable material is attracted to and retained on the side walls 16 by the strong magnets 24, which, as has been mentioned above, are typically made of Neodymium Iron Boron. At intervals, which can be predetermined or determined by inspection or other monitoring (e.g. flow rate), the outlet valve 21 is switched so that the flow goes in the direction 23 and compressed air drives the shuttles up into the illustrated release position within compartment 16. The material which is attached to the tubes 15 will then be washed away into the reservoir or sump by the flow of process liquid. Tube guides 30 surrounding the tube at the baffle plate 18, will help to wipe off any material which will tend to be dragged up by the moving shuffle 19. After a predetermined period, which can be short as the contaminate is actually washed out of the lower compartment 17, the outlet valve is returned to its original position and the shuttles 19 are driven back into the separator position. As the shuttles 19 always lie within the flow path, they will at all times be capturing contaminate, therefore the relative timing of the switching of the outlet valve 21 becomes much less critical and there is no need for a certain dead time whilst the magnets are restored to their separator position, as occurs with the prior art apparatus. Any material which is captured in the upper compartment, whilst the shuttles 19 are in their release position, will equally be released as the shuttles 19 move down into the lower compartment.

This released material will then be washed into the lower compartment and re-captured.

It will be noted that the tubes 15 are in a circular array. This has the significant advantage that the forces between the magnets are balanced allowing the magnets to be displaced in the tubes under relatively low pneumatic pressures. To achieve this advantage, the magnets should have the same pole at each end, otherwise there will not be a force balance.

The separator has been described and illustrated in a vertical orientation. It will be appreciated that this is the preferred arrangement, because the released material will tend to fall away, in the desired direction, under gravity as well as under the influence of the process liquid. However, it will be understood that, because the, process liquid is available to wash away the released material, the separator can, unusually, be used in other orientations and, to enhance this washing away process, it is possible for the pressure of the process liquid to be increased during the washing away or release phase.

Figure 3:
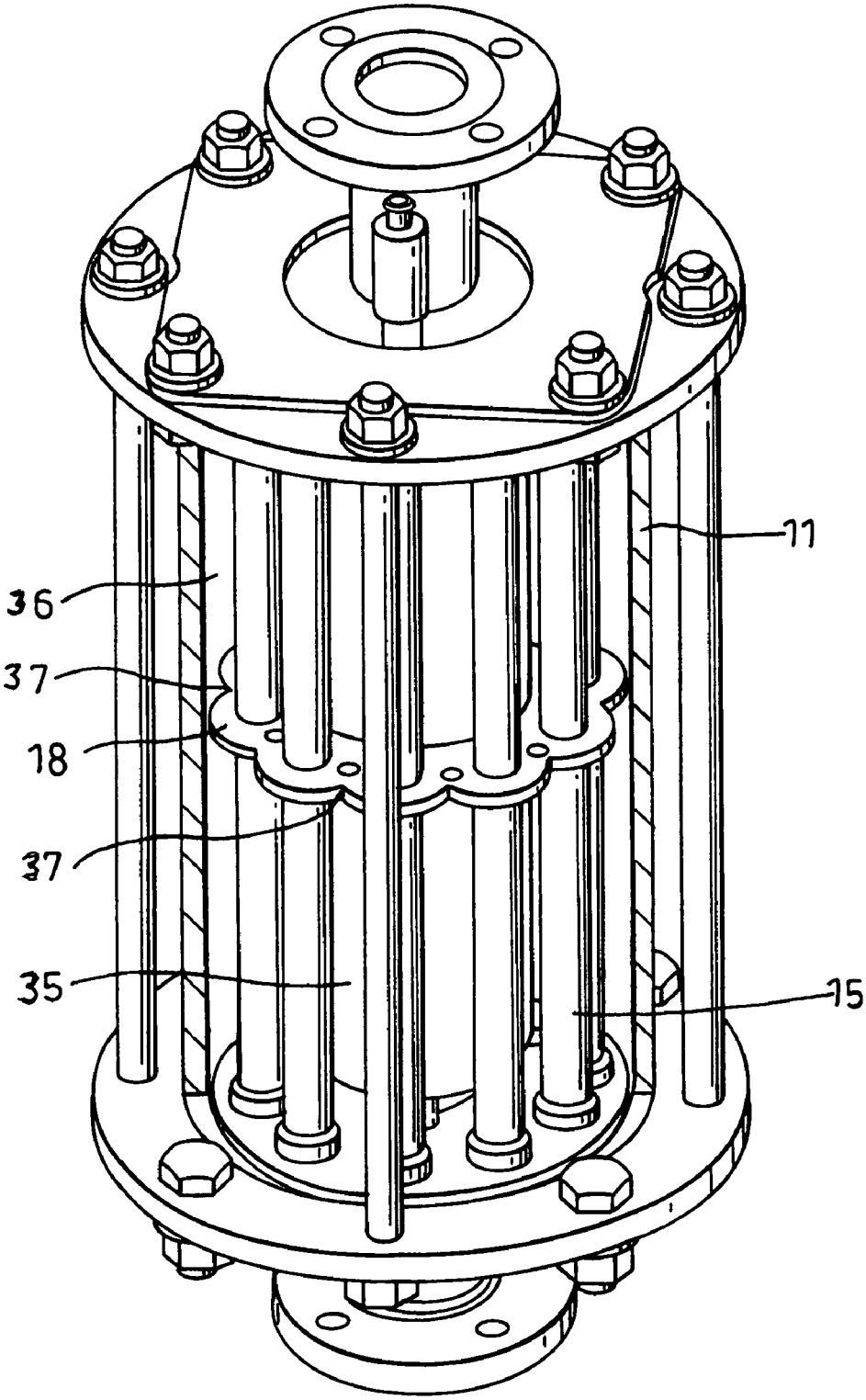
FIG. 3 is a perspective view of an alternative separator.

FIG. 3 illustrates a further development of the filter. A central tubular body 35 is disposed within the chamber 11 to confine the flow path to a generally annular chamber 36, thus ensuring that the fluid flows close to the tubes 15. The new annular baffle plate 18 has a profiled cut edge which defines curved indentations 37 between the tubes to allow fluid to flow down the chamber. The alternative is to stop the baffle plate 18 short of the wall of chamber 11.

In any of the cases a further direction valve may be provided at the inlet end, to allow separate flushing for the reasons set out above. Further if this valve is switched first to atmosphere and the chamber 11 drained, then collected material can be blown out of the chamber 11, by compressed air, which can be fed to and through the valve and can be collected in a bag or the like without the need for secondary separation.

The invention claimed is:

1. A magnetic separator for separating magnetic material from a fluid flow flowing in a flow path including one tube portion disposable in the flow path and a magnet within the tube portion movable between a separator position in the tube portion and a release position in which the magnet is withdrawn from the tube portion characterised in that the magnet is in the form of a shuttle and in that the tube portion is part of a longer tube disposable within the flow path whereby the magnet moves between its positions by differential pressure being created across the magnet, and further including an outlet valve for directing the fluid in a first direction when the shuttle is in its separator position and in a second direction when the shuttle is not in its separator position.

2. The separator as claimed in claim 1 wherein there are a plurality of tubes and a magnetic shuttle in each tube.

3. The separator as claimed in claim 2 wherein the tubes are arranged in a general circular array.

4. The separator as claimed in claim 3 wherein the tubes are disposed in a generally annular chamber.

5. The separator as claimed in claim 4 further comprising an annular baffle plate encircling the tubes at a location between the positions.

6. The separator as claimed in claimed in claim 5 wherein an edge of the baffle plate is profiled to allow fluid flow between the positions.

7. The separator according to claim 1, wherein the or each magnetic shuttle includes linear array of magnets and seals at either end of the array for sealing with an inner face of the tube.

8. The separator according to claim 1, further including control apparatus for supplying compressed air to the tube to move the shuttle between its positions.

9. The separator as claimed in claim 1 further including a baffle encircling the tube or tubes at a location between the positions.

10. The separator according to claim 1, wherein the tube is disposed in a chamber divided by a baffle plate through which the tube extends and the release position lies upstream of the baffle, whilst the separator position lies downstream of the baffle.

11. A magnetic separator for separating magnetic material from fluid flowing in a flow path comprising:

a plurality of tube portions disposable in the flow path, each tube portion being part of a larger tube disposable within the flow path;

a magnetic shuttle in each tube portion, the shuttles being movable between a separator position in the tube portion and a release position in which the magnetic shuttle is withdrawn from the tube portion; and an outlet valve for directing the fluid in a first direction when the shuttle is in its separator position and in a second direction when the shuttle is not in its separator position, whereby each shuttle moves between its positions by differential pressure being created across the shuttle, the tubes being arranged in an array whereby the forces between the magnets are balanced.

12. The separator as claimed in claim 11 wherein the tubes are arranged in a general circular array.

13. The separator as claimed in claim 11 wherein the tubes are disposed in a generally annular chamber.

14. The separator as claimed in claim 11 further comprising an annular baffle plate encircling the tubes at a location between the positions.

15. The separator as claimed in claimed in claim 11 wherein an edge of the baffle plate is profiled to allow fluid flow between the positions.

16. The separator as claimed in claim 11 further including a baffle encircling the tube or tubes at a location between the positions.

17. The separator according to claim 11 wherein at least one magnetic shuttle includes linear array of magnets and seals at either end of the array for sealing with an inner face of the tube.

18. The separator according to claim 11, further including control apparatus for supplying compressed air to the tube to move the shuttle, or shuttles, between its positions.

19. The separator according to claim 11, wherein the tubes are disposed in a chamber divided by a baffle plate through which the tubes extend and the release position lies upstream of the baffle, whilst the separator position lies downstream of the baffle.

20. A magnetic separator for separating magnetic material from fluid flowing in a flow path comprising:

a plurality of tube portions disposable in the flow path, each tube portion being part of a larger tube disposable adjacent the flow path;

a magnetic shuttle in each tube portion, the shuttles being movable between a separator position in the tube portion and a release position in which the magnetic shuttle is withdrawn from the tube portion; and an outlet valve for directing the fluid in a first direction when the magnetic shuttle is in its separator position and in a second direction when the shuttle is not in its separator position, whereby each shuttle moves between its positions by differential pressure being created across the shuttle, the tubes being arranged in a circular array whereby the forces between the magnets are balanced.

21. The separator as claimed in claim 20 wherein the tubes are disposed in a generally annular chamber.

22. The separator as claimed in claim 20 further comprising an annular baffle plate encircling the tubes at a location between the positions.

23. The separator as claimed in claimed in claim 20 wherein an edge of the baffle plate is profiled to allow fluid flow between the positions.

24. The separator as claimed in claim 20 further including a baffle encircling the tube or tubes at a location between the positions.

25. The separator according to claim 20 wherein at least one magnetic shuttle includes linear array of magnets and seals at either end of the array for sealing with an inner face of the tube.

26. The separator according to claim 20, further including control apparatus for supplying compressed air to the tube to move the shuttle, or shuttles, between its positions.

27. The separator according to claim 20, wherein the tubes are disposed in a chamber divided by a baffle plate through which the tubes extend and the release position lies upstream of the baffle, whilst the separator position lies downstream of the baffle.

* * * * *